US012044028B2

(12) United States Patent
Yang

(10) Patent No.: US 12,044,028 B2
(45) Date of Patent: Jul. 23, 2024

(54) TENT AND TENT POLE THEREOF

(71) Applicant: Zhejiang Hengfeng Top Leisure Co., Ltd., Zhejiang (CN)

(72) Inventor: Baoqing Yang, HangZhou (CN)

(73) Assignee: Zhejiang Hengfeng Top Leisure Co., Ltd., Zhejiang (CN)

( * ) Notice: Subject to any disclaimer, the term of this patent is extended or adjusted under 35 U.S.C. 154(b) by 224 days.

(21) Appl. No.: 17/828,496

(22) Filed: May 31, 2022

(65) Prior Publication Data

US 2023/0212873 A1 Jul. 6, 2023

(30) Foreign Application Priority Data

Dec. 31, 2021 (CN) ..... 202123429393.2
May 7, 2022 (CN) ..... 202221088826.4

(51) Int. Cl.
*E04H 15/48* (2006.01)
*E04H 15/54* (2006.01)

(52) U.S. Cl.
CPC ..... *E04H 15/48* (2013.01); *E04H 15/54* (2013.01)

(58) Field of Classification Search
None
See application file for complete search history.

(56) References Cited

U.S. PATENT DOCUMENTS 1,090,738 A 3/1914 McDonald
3,371,671 A 3/1968 Kirkham
4,066,089 A 1/1978 Rainwater
5,577,799 A 11/1996 St. Germain
6,089,247 A 7/2000 Price
6,216,717 B1 4/2001 Chen
6,666,223 B2 12/2003 Price et al.
6,814,094 B1 11/2004 Barber
7,357,140 B2 4/2008 Chu et al.
7,367,348 B2 * 5/2008 Tsai ..... E04H 15/50 135/147
7,451,776 B2 11/2008 Chen
7,753,064 B2 7/2010 Sy-Facunda
7,775,229 B2 8/2010 Sy-Facunda
7,784,480 B2 8/2010 Sy-Facunda
8,544,489 B2 10/2013 Choi
8,616,226 B2 12/2013 Ma et al.
8,746,267 B2 6/2014 Lovley, II et al.
(Continued)

FOREIGN PATENT DOCUMENTS

CN 203742255 U 7/2014
CN 103410373 B 11/2015
KR 20160113752 A 10/2016

*Primary Examiner* — David R Dunn
*Assistant Examiner* — Danielle Jackson
(74) *Attorney, Agent, or Firm* — Thompson Coburn LLP

(57) ABSTRACT

Disclosed are a tent and a tent pole thereof. The tent pole includes a support rod mounted on a tent body and an eaves pole rotatably connected with the support rod. The support rod is provided with a first limiting member configured to limit the eaves pole when the eaves pole is unfolded, and a second limiting member configured to limit the eaves pole when the eaves pole is stored. According to the tent pole provided by the present application, the eaves pole is rotatably connected with the support rod, and can be integrally set up or packed up with the tent body without disassembly or increasing additional package size.

17 Claims, 4 Drawing Sheets

(56) References Cited

U.S. PATENT DOCUMENTS

| | | | | |
|---|---|---|---|---|
| 8,893,737 | B2 | 11/2014 | Yang | |
| 9,528,292 | B1 | 12/2016 | Lovley, II et al. | |
| 9,580,929 | B2 | 2/2017 | Ma et al. | |
| 9,739,073 | B2 | 8/2017 | Huang | |
| 9,926,720 | B2 | 3/2018 | Huang | |
| 10,119,297 | B2 * | 11/2018 | Choi | E04H 15/50 |
| 10,280,645 | B1 | 5/2019 | Yang | |
| 10,309,121 | B2 * | 6/2019 | Choi | E04H 15/50 |
| 10,697,196 | B2 * | 6/2020 | Nicholson, Jr. | E04H 15/58 |
| 10,982,466 | B2 * | 4/2021 | Huang | E04H 15/50 |
| 11,072,943 | B2 * | 7/2021 | Sun | E04H 15/32 |
| 11,377,869 | B2 * | 7/2022 | Yang | E04H 15/48 |
| 2006/0174929 | A1 | 8/2006 | Tseng | |
| 2007/0051397 | A1 | 3/2007 | Choi | |
| 2007/0221262 | A1 | 9/2007 | Tsai et al. | |
| 2010/0043856 | A1 * | 2/2010 | Park | E04H 15/50 135/145 |
| 2011/0073148 | A1 | 3/2011 | Choi | |
| 2013/0284225 | A1 | 10/2013 | Holland et al. | |
| 2014/0174491 | A1 | 6/2014 | Yang | |
| 2015/0144169 | A1 | 5/2015 | Hunt et al. | |
| 2015/0376913 | A1 | 12/2015 | Choi | |
| 2016/0108639 | A1 | 4/2016 | Huang | |
| 2018/0142493 | A1 | 5/2018 | Choi | |
| 2020/0157838 | A1 * | 5/2020 | Yuan | E04H 15/50 |
| 2021/0198918 | A1 | 7/2021 | Yang | |

* cited by examiner

TENT AND TENT POLE THEREOF

RELATED APPLICATION DATA

This application claims priority benefit to Chinese patent application ser. no. 202123429393.2 filed Dec. 31, 2021, and Chinese patent application ser. no. 202221088826.4, filed May 7, 2022, the disclosures of which are incorporated by reference herein.

FIELD

The present application relates to the technical field of tents, and in particular to a tent pole assembly and a tent using the tent pole.

BACKGROUND

In the use of tents, in order to facilitate storage, a tent pole and a tent body are generally packed up together to improve storage efficiency and save time. For tents with an eaves pole, the eaves pole may extend to the outside of the tent body to support the edge of the tent body and play the role of a tent edge.

In the conventional technology, the eaves pole generally needs to be separated from the tent body and detached separately when the eaves pole is disassembled, which is easy to lose and inconvenient to store. If the eaves pole is lost, the next use will be hindered.

Therefore, how to facilitate the storage of the tent pole is a technical problem that needs to be solved by those skilled in the art.

SUMMARY

An object according to the present application is to provide a tent with a tent pole, which does not need to disassemble the eaves pole, and is convenient to store and use.

To achieve the above object, the following technical solutions are provided according to the present application.

In one aspect, a tent includes a tent pole with a support rod and an eaves pole rotatably connected with the support rod.

In one aspect, a first limiting member is arranged on a body of the tent. The eaves pole is configured to releasably connect with or have a snap-fit with the first limiting member when the eaves pole is unfolded, for instance, when the tent is used and the eave is deployed. The part of the tent body that includes the first limiting member may be releasably connected with the support rod.

In another aspect, a second limiting member is arranged on the tent body. The eaves pole is configured to be releasably connected with or to have a snap-fit with the second limiting member when the eaves pole is stored, for instance when the eave is removed or the tent is folded. The part of the tent body that includes the second limiting member may be releasably connected with the support rod.

Preferably, the first limiting member and/or the second limiting member are sewn on the tent body.

A target portion of the support rod is connected with the tent body. The target portion may be adjacent to the eaves pole rotatable connection with the support rod. Target portion of the support rod that is connected with tent body may be close in proximity to the first limiting member.

Preferably, the first limiting member and the second limiting member each include a connecting member allows the limiting member to be fixed on the tent body. Preferably, the connecting member is a plastic member.

Preferably, the first limiting member and the second limiting member are respectively located on two sides of a connection point of the support rod and the eaves pole.

Preferably, the eaves pole is cylindrical, and the first limiting member and the second limiting member are both C-shaped.

The first limiting member and the second limiting member are both clamping fasteners.

Preferably, the support rod and an end of the eaves pole are connected by a rotating assembly. The first limiting member is located at a first end of the support rod, and the rotating assembly is arranged on a side of the support rod close to the first end; and a length of the eaves pole is greater than a distance between the first end of the support rod and the rotating assembly. Preferably, the target portion of the support rod is close in distance to the first limiting member.

Preferably, the rotating assembly includes a support member and a rotating member, the support member is sleeved on the support rod, and the rotating member is connected with one end of the eaves pole.

Preferably, a connecting table is arranged on the support member. The rotating member is provided with a U-shaped connecting portion which can cooperate with the connecting table. The connecting portion can swing relative to the connecting table.

The tent provided according to the present application includes the tent body and the tent pole. The tent pole includes the support rod and the eaves pole rotatably connected with the support rod. The tent includes the first limiting member fixed on the tent body and includes the second member fixed on the tent body, which is convenient for use of the tent. The target portion of the support rod may be connected with the tent body. The eaves pole may be configured to snap-fit with the first limiting member when the eaves pole is unfolded, and the eaves pole may be configured to snap-fit with the second limiting member when the eaves pole is stored. The part of the tent body having the first limiting member may be separable from the support rod. The part of the tent body having the second limiting member may be separable from the support rod. In the tent provided by the present application, the eaves pole is rotatably connected with the support rod, and can be integrally set up or packed up with the tent body without disassembly or increasing additional package size.

The tent according to the present application is provided with the above-mentioned tent pole. Since the tent pole has the above technical effects, the tent provided with the tent pole also has the corresponding technical effects.

BRIEF DESCRIPTION OF THE DRAWINGS

For more clearly illustrating embodiments of the present application or the technical solutions in the conventional technology, drawings referred to for describing the embodiments or the conventional technology will be briefly described hereinafter. Apparently, drawings in the following description are only examples of the present application, and for the person skilled in the art, other drawings may be obtained based on the provided drawings without any creative efforts.

FIG. 6-1 is a front view of a support member in the rotating assembly shown in FIG. 5;

FIG. 6-2 is a right side view of the support member in the rotating assembly shown in FIG. 5;

FIG. 6-3 is a cross-sectional view of the support member in the rotating assembly shown in FIG. 5;

FIG. 7-1 is a front view of a rotating member in the rotating assembly shown in FIG. 5; and FIG. 7-2 is a top view of the support member in the rotating assembly shown in FIG. 5.

FIG. 8-1 is a schematic view of an unfolded structure of a tent pole according to another specific embodiment provided by the present application;

FIG. 8-2 is a schematic view of a folding process of the tent pole of the embodiment of FIG. 8-1;

FIG. 8-3 is a schematic view of a folded structure of the tent pole of the embodiment of FIG. 8-1.

DETAILED DESCRIPTION OF THE EMBODIMENTS

A core of the present application is to provide a tent 10 with a tent pole 50. For the exemplary tent 10, there is no need to disassemble an eaves pole 200 of the tent, and the eaves pole is directly fixed to a support rod comprising the tent skeleton so the eaves pole is convenient to store and use. Also, the tent is less expensive to manufacture.

The technical solutions according to the embodiments of the present application will be described clearly and completely as follows in conjunction with the drawings in the embodiments of the present application. It is apparent that the described embodiments are only a part of the embodiments according to the present application, rather than all of the embodiments. Based on the embodiments in the present application, all of other embodiments, made by the person skilled in the art without any creative efforts, fall into the scope of protection of the present application.

Figure 1:
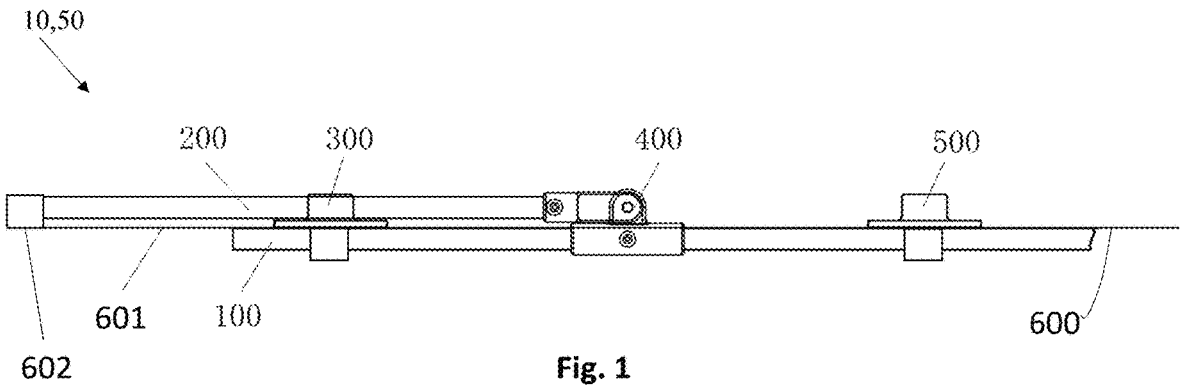
FIG. 1 is a schematic view of an unfolded structure of a tent pole according to a specific embodiment provided by the present application.
Figure 2:
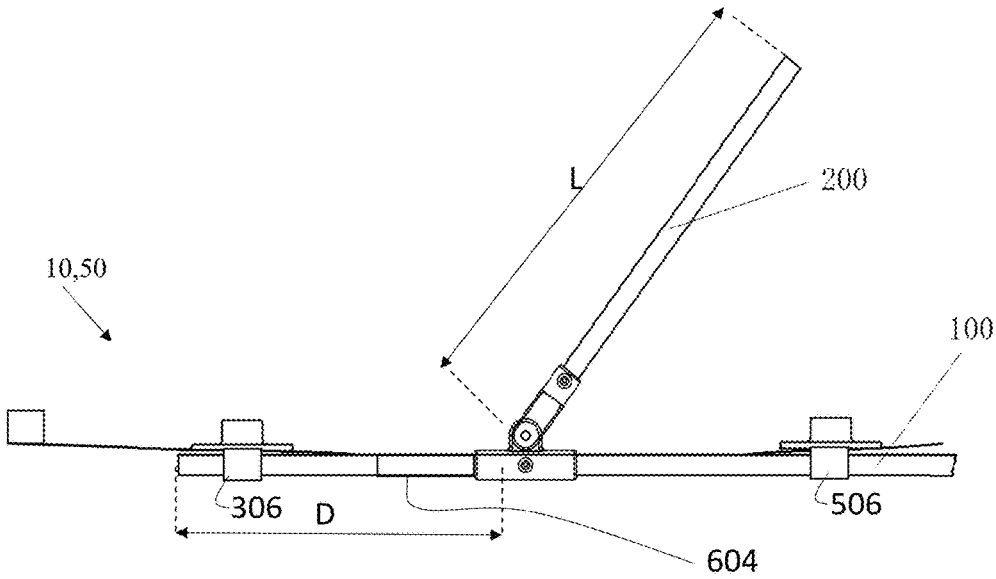
FIG. 2 is a schematic view of a folding process of the tent pole according to the specific embodiment provided by the present application.
Figure 3:
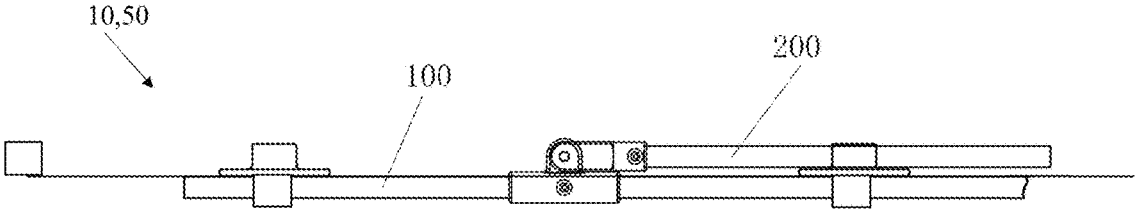
FIG. 3 is a schematic view of a folded structure of the tent pole according to the specific embodiment provided by the present application.
Figure 4:
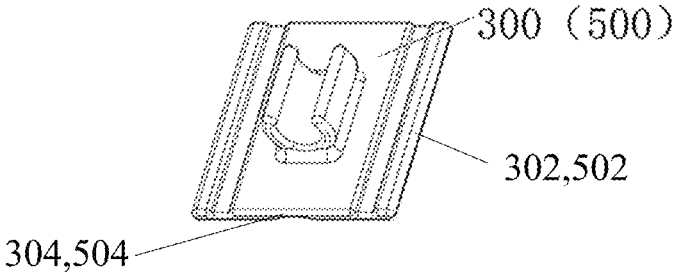
FIG. 4 is a schematic structural view of a first limiting member or a second limiting member in the tent pole provided by the present application.
Figure 5:
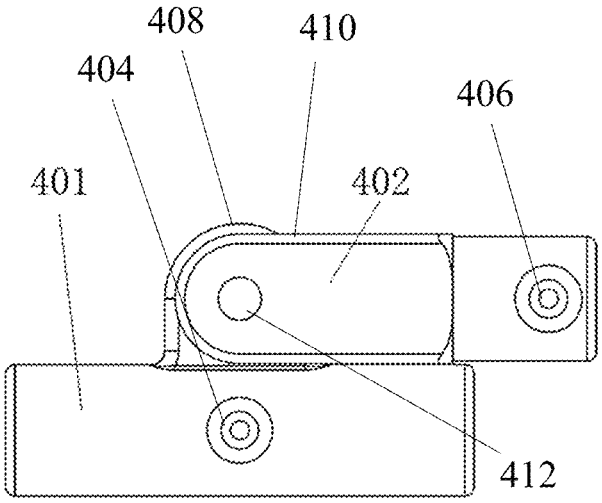
FIG. 5 is a schematic structural view of a rotating assembly in the tent pole provided by the present application.
Figures 1, 6:
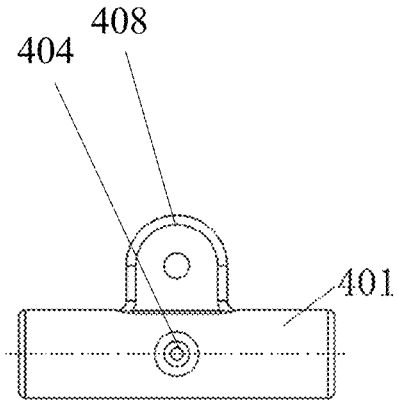
Figures 2, 6:
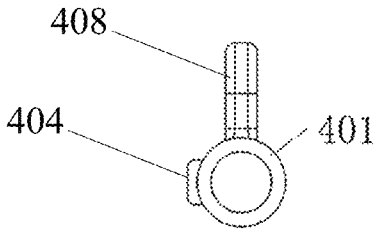
Figures 3, 6:
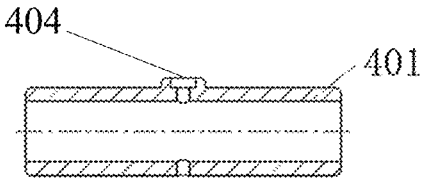
Figures 1, 7:
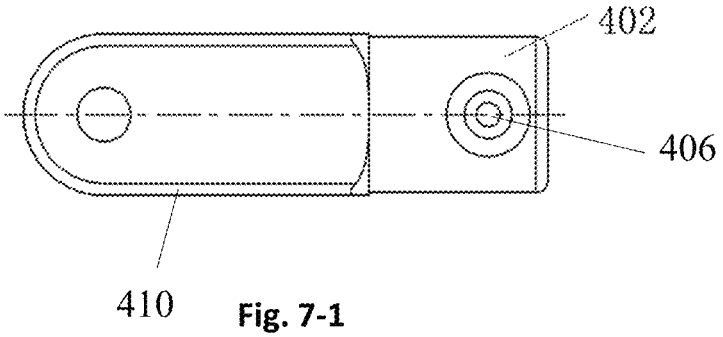
Figures 2, 7:
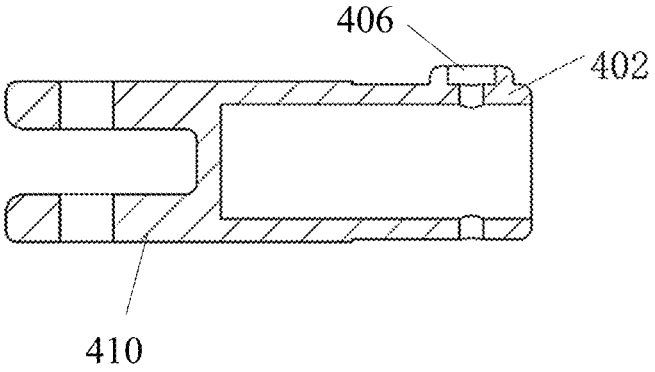
Figures 1, 8:
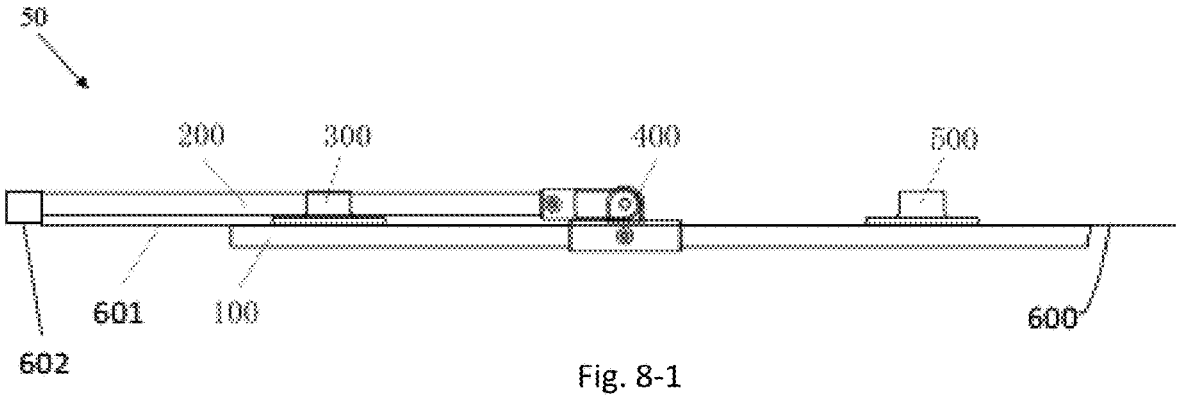
Figures 2, 8:
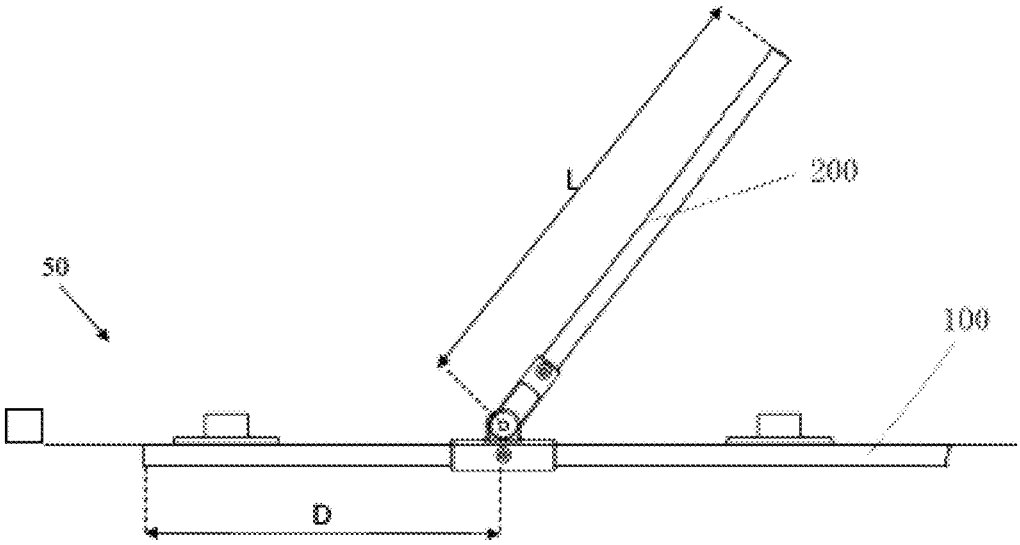
Figures 3, 8:
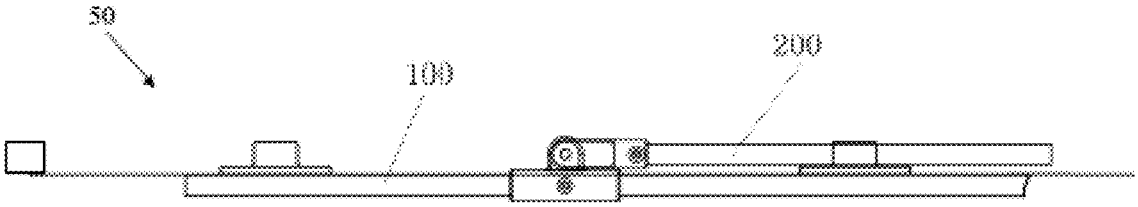

Reference is made to FIGS. 1 to 6, 7-1 through 7-2, and 8-1 through 8-3. FIG. 1 is a schematic view of an unfolded structure of a tent pole according to a specific embodiment provided by the present application. FIG. 2 is a schematic view of a folding process of the tent pole according to the specific embodiment provided by the present application. FIG. 3 is a schematic view of a folded structure of the tent pole according to the specific embodiment provided by the present application. FIG. 4 is a schematic structural view of a first limiting member or a second limiting member in the tent pole provided by the present application. FIG. 5 is a schematic structural view of a rotating assembly in the tent pole provided by the present application. FIG. 6-1 is a front view of a support member in the rotating assembly shown in FIG. 5. FIG. 6-2 is a right side view of the support member in the rotating assembly shown in FIG. 5. FIG. 6-3 is a cross-sectional view of the support member in the rotating assembly shown in FIG. 5. FIG. 7-1 is a front view of a rotating member in the rotating assembly shown in FIG. 5. FIG. 7-2 is a top view of the support member in the rotating assembly shown in FIG. 5. FIGS. 8-1 through 8-3 show an alternative embodiment of the tent pole.

In a first embodiment, the tent 10 includes a tent body 600 and a tent pole 50 includes a support rod 100 and an eaves pole 200. The tent pole 50 is the skeleton of the tent 10, and the tent body 600 is connected with the tent pole at least at a target portion of a support rod 100 of the tent pole 50. The eaves pole 200 is rotatably connected with the support rod 100. Thus, the tent pole 50 includes the support rod 100 and an eaves pole 200. In such first embodiment, the tent body 600 has a first limiting member 300 and a second limiting member 500 that cooperate with the eaves pole 200. The support rod 100 may be connected with the tent body 600 at a target area 604 to serve as a skeleton of the tent body 600 and play a supporting role. The support rod 100 may also be removably connected with the tent body 600 at an area adjacent to the first limiting member 300 and at an area adjacent to the second limiting area 500, as will be described.

Preferably, the tent is provided with the first limiting member 300 fixed on the tent body 600. The eaves pole 200 may be configured to releasably connect or have a snap-fit with the first limiting member 300 when the eaves pole is unfolded, for instance, when the tent is in normal use and the eave is deployed. The part of the tent body 600 that includes the first limiting member 300 can be releasably connected with or selectively separated from the support rod 100. For instance, the first limiting member 300 may have a clip 306 (similar to the clip that engages the eave pole as shown in FIG. 4) on its base 304 that extends through the tent body 604 and releasably engages the support rod 100. The tent body 600 may have releasably connectable loops, fasteners or connectors adjacent the first limiting member 300 that engage the support rod. By mounting the first limiting member 300 directly on the tent body 600 and allowing the first limiting member 300 to be removably connected with the support rod 100, the tent may be easier to manufacture. Moreover, because the area or part of the tent body 600 that includes the first limiting member 300 can be separated from the support rod 100, the tent body 600 can be less confined to the support rod 100, which further facilitates storage.

Preferably, the tent further includes a second limiting member 500 fixed on the tent body 600. The eaves pole 200 may be configured to releasably connect with or have a snap-fit with the second limiting member 500 when stored. The part of the tent body 600 that includes the second limiting member 500 may be releasably connected with or selectively separated from the support rod 100. For instance, the second limiting member 500 may have a clip 506 (similar to the clip that engages the eave pole as shown in FIG. 4) on its base 504 that extends through the tent body 604 and releasably engages the support rod 100. The tent body may have releasably connectable loops, fasteners or connectors adjacent the second limiting member 500 that engage the support rod 100. Similarly, by mounting the second limiting member 500 directly on the tent body 600 and allowing the second limiting member to be removably connected with the support rod 100, the tent may be easier to manufacture. Moreover, because the part of the tent body 600 that includes the second limiting member 500 may be separated from the support rod 100, the tent body 600 can be less confined to the support rod 100, which further facilitates storage.

A target portion 604 of the support rod 100 may be fixedly connected with the tent body 600. For instance, the tent body and target portion of the support rod may be sleeved or provided with a rivet, loop, snap, hook and loop material or other connector. Preferably, the target portion 604 of the support rod 100 is in close proximity to the first limiting member 300. That is, the target portion 604 of the support rod 100 that is fixed with the tent body may be on the side of the support rod close to the outer end and may be fixedly connected with the tent body 600. The target portion 604 of the support rod 600 that is fixed with the tent body may be adjacent to the eaves pole rotatable connection with the support rod. The inner end of the support rod 100 may be connected with a hub, that is, a central winch of the tent stand, which is convenient for one-button folding.

On the basis of the above-mentioned embodiments, the first limiting member 300 and/or the second limiting member 500 may be sewn on the tent body 600. That is, the first limiting member 300 and/or the second limiting member 500 are fixed on a soft surface of the tent body 600 by sewing. With the above arrangement, the first limiting member 300 and the second limiting member 500 are directly connected on the tent body 600 during manufacture of the tent body, which is convenient and lower in manufacturing cost. The first limiting member 300 and the second limiting member 500 can be fixed to the tent body 600 by other means, such as gluing or rivets.

On the basis of the above-mentioned embodiments, both the first limiting member 300 and the second limiting member 500 include connecting members 302,502 that can be used to fix the respective limiting member on the tent body 600. Specifically, the connection can be realized by sewing the connecting members 302,502, corresponding to the first limiting member 300 and the second limiting member 500, on the tent body 600. Preferably, the connecting member 302,502 may be a plastic member, preferably a soft plastic member which is convenient for sewing on the tent body 600. The connecting member 302,502 may also be in other form as long as this form is convenient for sewing with the tent body 600. For example, the connecting member 302,502 can be a connecting sheet on which multiple through holes are provided.

On the basis of the above-mentioned embodiments, the first limiting member 300 and the second limiting member 500 are both located on an outer or exterior side of the tent body 600, and the support rod 100 is located on an inner or interior side of the tent body 600. That is, the tent body 600 is sandwiched between the support rod 100 and the first limiting member 300, and between the support rod 100 and the second limiting member 500.

Preferably, the first limiting member 300 and the second limiting member 500 have the same structure. Of course, they may also have different structures. Preferably, the first limiting member 300 and the second limiting member 500 are both clamping or snapping fasteners.

On the basis of the above-mentioned embodiments, the first limiting member 300 and the second limiting member 500 are respectively located on two sides of a connection point of the support rod 100 and the eaves pole 200. That is, when the eaves pole 200 is rotated to one side of the connection point relative to the support rod 100, the eaves pole 200 is in an unfolded position for supporting an eave 601 of the tent body 600, and when the eaves pole 200 is rotated to another side of the connection point relative to the support rod 100, the eaves pole 200 is in a folded position where the eaves poles may be stored.

On the basis of the above-mentioned embodiments, the eaves pole 200 is cylindrical, and the first limiting member 300 and the second limiting member 500 are both C-shaped, which has an acceptable clamping effect and is convenient to disassemble. Of course, the limiting members may have other structures.

On the basis of the above-mentioned embodiments, the support rod 100 and an end of the eaves pole 200 are connected by a rotating assembly 400. The first limiting member 300 is located at a first end of the support rod 100, and the rotating assembly 400 is arranged on a side of the support rod 100 close to the first end.

On the basis of the above-mentioned embodiments, the rotating assembly 400 includes a support member 401 and a rotating member 402, the support member 401 is sleeved on the support rod 100, and the rotating member 402 is connected with one end of the eaves pole 200. Specifically, the support member 401 is provided with a fastening hole 404 configured to fasten the support member 401 and the support rod 100. The rotating member 402 is provided with a fastening hole 406 configured to fasten the rotating member 402 and the eaves pole 200.

On the basis of the above-mentioned embodiments, a connecting tab 408 is arranged on the support member 401, and the connecting tab is preferably semicircular. The rotating member 402 is provided with a U-shaped connecting portion 410 which can cooperate with the connecting tab 408. The connecting portion 410 can swing relative to the connecting tab 408 via a pivot connection 412, preferably on a plane where the support rod 100 is located.

Preferably, the distance between the second limiting member 500 and the rotating assembly 400 is the same as the distance between the first limiting member 300 and the rotating assembly 400, which is more aesthetically pleasing.

Specifically, the length L of the eaves pole 200 should be greater than the distance D between the first end of the support rod 100 and the rotating assembly 400. The end of the eaves pole 200 away from the rotating assembly 400 extends out of the tent to form the eave 601, and is connected with a soft surface of the tent body by a plastic part or pocket 602 of the tent body, so as to realize the supporting effect of the eaves pole 200.

When disassembling, the eaves pole 200 is disconnected from the soft surface of the tent body, and the eaves pole 200 is pulled out from the first limiting member 300 and is rotated to another side with the support member 401 of the rotating assembly 400 as the axis, and is clamped in the second limiting member 500 on the tent body.

According to the tent pole provided by the present application, the eaves pole 200 is rotatably connected with the support rod 100, and can be integrally set up or packed up with the tent body 600 without disassembly or increasing additional package size. Further, the first limiting member 300 is directly fixed on the tent body 600, which facilitates installation. Moreover, because the part of the tent body 600 that includes the first limiting member 300 can be releasably connected with the support rod 100, and the part of the tent body 600 that includes the second limiting member 500 may be releasably connected with the support rod, and the support rod 100 is fixed with the tent body 600 only at the target portion of the support rod and at the hub, storage and folding of the tent is facilitated.

In addition to the above-mentioned tent pole, the present application further provides a tent including the tent body 600 and the above-mentioned tent pole. The tent is preferably a HUB tent, that is, a quick-release tent. For the structure of other parts of the tent, reference can be made to the conventional technology, which is not repeated here.

Making reference to FIGS. 8-1 through 8-3, in the alternative to the above described embodiments, the support rod 100 (rather than the tent body 600) may be provided with one or both of the limiting members 300,500. In this configuration, the limiting members 300,500 perform the same function, that is, the first limiting member 300 is configured to releasably engage the eaves pole 200 when the eaves pole is unfolded, and the second limiting member 500 is configured to releasably engage the eaves pole 200 when the eaves pole is stored. However, rather than affixing the limiting members 300,500 to the tent body 600, the limiting members may be affixed to the support rod 100 and extend through a hole or pocket in the tent body to engage the eaves pole. In such a configuration, the first limiting member 300 and/or the second limiting member 500 may each include a base 304,504. The base 304,504 of the limiting member may be fixedly connected with the support rod 100. The first and second limiting member 300,500 may also be releasably connected to the support rod 100. Of course, one or both of the limiting members may be fixedly connected or removably connected with the support rod. Also, other combinations are possible, including having one of the limiting members fixed to the tent body as described above with the other of the limiting members being either fixedly connected or removably connected with the support rod.

The above embodiments are described in a progressive manner. Each of the embodiments is mainly focused on describing its differences from other embodiments, and reference may be made among these embodiments with respect to the same or similar parts.

The tent pole according to the present application has been described in detail hereinbefore. The principle and embodiments of the present application are described through specific examples herein. The description of the above-described embodiments is merely used to facilitate understanding the method and core idea of the present application. It should be noted that, for those skilled in the art, various improvements and modifications may be further made to the present application without departing from the principle of the present application, and these improvements and modifications also fall within the protection scope defined by the claims of the present application.

The invention claimed is:

1. A tent comprising a tent body and a tent pole for supporting the tent body, the tent pole comprising a support rod and an eaves pole rotatably connected with the support rod, the eaves pole being movable between an unfolded position where the eaves pole supports an eave of the tent and a folded position where the eaves pole is stored, the tent having a first limiting member configured to releasably engage the eaves pole when the eaves pole is in the unfolded position, and a second limiting member configured to releasably engage the eaves pole when the eaves pole is in the folded position;

wherein at least one of the first and second limiting members are provided on the tent body.

2. The tent of claim 1 wherein at least one of the first and second limiting members are sewn on the tent body.

3. The tent of claim 1 wherein at least one of the first and second limiting members have a connecting member allowing the respective limiting member to be fixed on the tent body.

4. The tent of claim 1 wherein a portion of the tent body having the first limiting member is releasably connected to the support rod.

5. The tent of claim 1 wherein a portion of the tent body having the second limiting member is releasably connected to the support rod.

6. The tent of claim 1 wherein at least one of the first and second limiting members are releasably connected to the support rod.

7. The tent of claim 1 wherein the first limiting member and the second limiting member are respectively located on opposite sides of a connection point of the support rod and the eaves pole.

8. The tent of claim 1 wherein the tent body is disposed between the support rod and the first limiting member or between the support rod and the second limiting member.

9. The tent of claim 1 wherein the eaves pole is cylindrical, and the first limiting member and the second limiting member are both C-shaped to releasably engage the eaves pole in the folded and unfolded positions.

10. The tent of claim 1 wherein at least one of the first limiting member and the second limiting member has a base which is fixed on the support rod.

11. The tent of claim 1 wherein at least one of the first limiting member and the second limiting member is located on an outer side of the tent body, and the support rod is located on an inner side of the tent body.

12. The tent of claim 1 wherein the eaves pole has a proximal end and a distal end and a length extending between the proximal and distal ends, the proximal end of the eaves pole is connected to the support rod with a rotating assembly, the support rod extends from the rotating assembly and terminates at a distal end of the support rod, the first limiting member is located adjacent the distal end of the support rod, the length of the eaves pole is greater than a distance between the distal end of the support rod and the rotating assembly.

13. The tent of claim 12 wherein the rotating assembly comprises a support member and a rotating member, the support member is sleeved on the support rod, and the rotating member is connected with the proximal end of the eaves pole.

14. The tent of claim 12 wherein the supporting member has a connecting tab, the rotating member has a U-shaped connecting portion that is configured to cooperate with the connecting tab, and the connecting portion is configured to swing relative to the connecting tab.

15. The tent of claim 1 wherein a portion of the support rod is connected with the tent body.

16. The tent of claim 15 wherein the portion of the support rod connected with the tent body is adjacent to the first limiting member.

17. The tent of claim 15 wherein the portion of the support rod connected with the tent body is adjacent to a rotary connection of the support rod with the eaves pole.

* * * * *